US010847305B2

(12) United States Patent
Ashizawa et al.

(10) Patent No.: US 10,847,305 B2
(45) Date of Patent: Nov. 24, 2020

(54) COIL COMPONENT

(71) Applicant: TDK Corporation, Tokyo (JP)

(72) Inventors: Syun Ashizawa, Tokyo (JP); Masato Otsuka, Tokyo (JP); Hanako Yoshino, Tokyo (JP); Toshio Tomonari, Tokyo (JP); Kohei Wada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 280 days.

(21) Appl. No.: 16/170,349

(22) Filed: Oct. 25, 2018

(65) Prior Publication Data

US 2019/0131056 A1 May 2, 2019

(30) Foreign Application Priority Data

Oct. 26, 2017 (JP) ..... 2017-207382

(51) Int. Cl.

| | |
|---|---|
| ***H01F 27/28*** | (2006.01) |
| ***H01F 27/32*** | (2006.01) |
| *H01F 5/04* | (2006.01) |
| *H01F 5/00* | (2006.01) |

(52) U.S. Cl.

CPC ..... *H01F 27/2804* (2013.01); *H01F 27/2823* (2013.01); *H01F 27/2871* (2013.01); *H01F 27/323* (2013.01); *H01F 5/003* (2013.01); *H01F 5/04* (2013.01); *H01F 27/28* (2013.01)

(58) Field of Classification Search

CPC ..... H01F 27/2804; H01F 27/323; H01F 27/2871; H01F 27/2823; H01F 5/04; H01F 5/003

See application file for complete search history.

(56) References Cited

U.S. PATENT DOCUMENTS

| | | | | |
|---|---|---|---|---|
| 6,650,220 | B2 * | 11/2003 | Sia | H01F 17/0013 257/E21.022 |
| 6,750,750 | B2 * | 6/2004 | Jiong | H01L 27/08 257/E21.022 |
| 2011/0102125 | A1 | 5/2011 | Tamura et al. | |
| 2018/0286563 | A1 | 10/2018 | Shinkai et al. | |

FOREIGN PATENT DOCUMENTS

| | | | |
|---|---|---|---|
| JP | H08203739 | A | 8/1996 |
| JP | 2010016235 | A | 1/2010 |

* cited by examiner

*Primary Examiner* — Tuyen T Nguyen

(74) *Attorney, Agent, or Firm* — Young Law Firm, P.C.

(57) ABSTRACT

Disclosed herein is a coil component that includes an insulating substrate, a first coil part formed on the first surface of the insulating substrate, and a second coil part formed on the second surface of the insulating substrate. At least an innermost turn of the first coil part is radially separated by spiral-shaped slits into three or more conductor parts. At least an innermost turn of the second coil part is radially separated by spiral-shaped slits into three or more conductor parts. Inner peripheral ends of respective innermost to outermost conductor parts of the three or more conductor parts of the first coil part are connected to inner peripheral ends of the respective outermost to innermost conductor parts of the three or more conductor parts of the second coil part.

18 Claims, 14 Drawing Sheets

COIL COMPONENT

BACKGROUND OF THE INVENTION

Field of the Invention

The present invention relates to a coil component and, more particularly, to a coil component having a spiral-shaped planar conductor.

Description of Related Art

As a coil component used for various electronic devices, a coil component of a type in which a wire (coated wire) is wound around a magnetic core and, further, a coil component of a type in which a spiral-shaped planar conductor of a plurality of turns is formed on an insulating layer is known. For example, JP 1996-203739 A discloses a configuration in which a spiral-shaped planar conductor formed on the surface of an insulating substrate is radially separated into three sections by spiral-shaped slits. When the planar conductor is thus radially separated by the spiral-shaped slits, non-uniformity of current density distribution is reduced to make it possible to reduce DC resistance or AC resistance. However, in the planar conductor of JP 1996-203739 A, a large difference is generated between the electrical lengths of a conductor part positioned at the inner peripheral side and a conductor part positioned at the outer peripheral side, thus disadvantageously increasing AC resistance.

Although not a coil component using the planar conductor, Japanese Patent No. 4,752,879 discloses, in FIG. 8 of the document, a coil component having a configuration in which radial positions of four conductive wires wound flatwise are appropriately interchanged. Such interchange allows inner/outer peripheral difference to be canceled, thus making it possible to make the electrical lengths of the conductive wires uniform.

However, in a coil component of a type in which spiral-shaped planar conductors are formed on the front and back surfaces of the insulating substrate, respectively, only two layers of the planar conductors are used, so that the layout illustrated in FIG. 8 of Japanese Patent No. 4,752,879 cannot be realized. For example, at the interchange position 45 illustrated in FIG. 8 of Japanese Patent No. 4,752,879, the radial positions of the conductive wires 41 and 44 are interchanged. That is, the conductive wires 41 and 44 cross each other at the interchange position 45, so that in a configuration in which the planar conductor is used for the coil component, the remaining conductive wires 42 and 43 cannot pass the crossing portion.

SUMMARY

It is therefore an object of the present invention to provide a coil component, in which spiral-shaped planar conductors are formed on the front and back surfaces of the insulating substrate, capable of reducing the difference between the electrical lengths of the conductor parts positioned at the inner and outer peripheral sides even when each of the planar conductors is radially separated by spiral-shaped slits into three or more sections.

A coil component according to the present invention includes: an insulating substrate; a first coil part formed on one surface of the insulating substrate and spirally wound in a plurality of turns; and a second coil part formed on the other surface of the insulating substrate and spirally wound in a plurality of turns. At least the innermost turn of the first coil part is radially separated by spiral-shaped slits into three or more conductor parts, and at least the innermost turn of the second coil part is radially separated by spiral-shaped slits into three or more conductor parts. The inner peripheral ends of the respective innermost to outermost conductor parts of the three or more conductor parts of the first coil part are connected to the inner peripheral ends of the respective outermost to innermost conductor parts of the three or more conductor parts of the second coil part.

According to the present invention, the inner peripheral ends of the first and second coil parts which are formed on the front and back surfaces of the insulating substrate are connected to each other, and the radial positions of the conductor parts are interchanged at the connection parts, so that the difference between the electrical lengths of the conductor parts positioned at the inner and outer peripheral sides can be reduced.

In the present invention, a first conductor part included in the three or more conductor parts of the first coil part and positioned at the innermost peripheral side may be connected to a second conductor part included in the three or more conductor parts of the second coil part and positioned at the outermost peripheral side, a third conductor part included in the three or more conductor parts of the first coil part and positioned at the outermost peripheral side may be connected to a fourth conductor part included in the three or more conductor parts of the second coil part and positioned at the innermost peripheral side, the first and fourth conductor parts or second and third conductor parts may overlap each other in a plan view, whereby a first region surrounded in a plan view by the first conductor part, the third conductor part, and the second or fourth conductor part is defined, and a second region surrounded in a plan view by the second conductor part, the fourth conductor part, and the first or third conductor part is defined. The conductor part included in the three or more conductor parts of the first coil part, other than the first and third conductor parts may be connected to the conductor part included in the three or more conductor parts of the second coil part, other than the second and fourth conductor parts in a third region different from the first and second regions in a plan view. As described above, when the conductor part included in the three or more conductor parts of the first coil part, other than the first and third conductor parts is connected in the third region to the conductor part included in the three or more conductor parts of the second coil part, other than the second and fourth conductor parts, the radial positions of the conductor parts can be interchanged using the front and back surfaces of the insulating substrate irrespective of the number of separations of the first and second coil parts.

In the present invention, the innermost turn of the first coil part may be separated into three conductor parts including first, third, and fifth conductor parts, the innermost turn of the second coil part may be separated into three conductor parts including second, fourth, and sixth conductor parts, and the fifth and sixth conductor parts may be connected in the third region. This allows the difference between the electrical lengths of the conductor parts to be reduced in the configuration in which the first and second coil parts are each radially separated into three sections.

In the present invention, the innermost turn of the first coil part may have a fifth conductor part and a seventh conductor part positioned between the third and fifth conductor parts, the innermost turn of the second coil part may have a sixth conductor part and an eighth conductor part positioned between the fourth and sixth conductor parts, the fifth and sixth conductor parts may be connected to each other in the third region, and the seventh and eighth conductor parts may be connected to each other in the third region. This allows the difference between the electrical lengths of the conductor parts to be reduced in the configuration in which the first and second coil parts are each radially separated into four or more sections.

In the present invention, at least the innermost turn of the first coil part may have a ninth conductor part positioned between the fifth and seventh conductor parts, at least the innermost turn of the second coil part may have a tenth conductor part positioned between the sixth and eighth conductor parts, the fifth and eighth conductor parts or sixth and seventh conductor parts may overlap each other in a plan view, whereby a fourth region surrounded in a plan view by the fifth conductor part, seventh conductor part, and sixth or eighth conductor part is defined, and a fifth region surrounded in a plan view by the sixth conductor part, eighth conductor part, and fifth or seventh conductor part is defined. The ninth conductor part may be connected to the tenth conductor part in a sixth region different from the first, second, fourth, and fifth regions in a plan view. This allows the difference between the electrical lengths of the conductor parts to be reduced in the configuration in which the first and second coil parts are each radially separated into five or more sections.

In the present invention, the turns constituting the first coil part including the innermost turn thereof may each separated into at least first, third, fifth, and seventh conductor parts by slits, and the turns constituting the second coil part including the innermost turn thereof may each separated into at least second, fourth, sixth, and eighth conductor parts by slits. This further reduces non-uniformity of current density, allowing further reduction in DC resistance or AC resistance.

In the present invention, the number of turns of each of the third and seventh conductor parts may be larger by one turn than the number of turns of each of the first and fifth conductor parts, and the number of turns of each of the second and sixth conductor parts may be larger by one turn than the number of turns of each of the fourth and eighth conductor parts. This allows the total number of turns to be an odd number.

In the present invention, the first and second coil parts each have a circumferential region in which the radial position is not changed and a shift region in which the radial position is changed. This can facilitate pattern design or pattern change as compared to a case where the coil part is formed into a spiral shape as a whole in which the radial position of the conductor pattern is gradually changed.

In the present invention, the circumferential regions of the first coil part and the circumferential regions of the second coil part may coincide with each other in planar position. This facilitates outer appearance inspection when the insulating substrate is transparent or translucent.

As described above, according the present invention, in the coil component in which the spiral-shaped planar conductors are formed on the respective front and back surfaces of the insulating substrate, it is possible to reduce the difference between the electrical lengths of the conductor parts positioned at the inner and outer peripheral sides.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
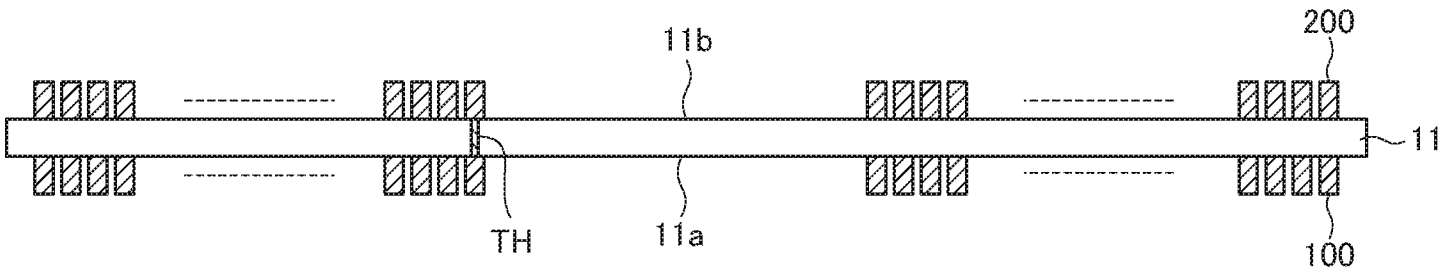
FIG. 1 is a cross-sectional view illustrating the configuration of a coil component according to a first embodiment of the present invention.

FIG. 1 is a cross-sectional view illustrating the configuration of a coil component according to the first embodiment of the present invention.

As illustrated in FIG. 1, the coil component according to the present embodiment includes an insulating substrate 11, a first coil part 100 formed on one surface 11*a* of the insulating substrate 11, and a second coil part 200 formed on the other surface 11*b* of the insulating substrate 11. Although details will be described later, the inner peripheral ends of the first coil part 100 and the inner peripheral ends of the second coil part 200 are connected to each other through a plurality of connection parts TH penetrating the insulating substrate 11.

Although there is no particular restriction on the material of the insulating substrate 11, a transparent or translucent flexible material such as PET resin may be used. Alternatively, the insulating substrate 11 may be a flexible substrate obtained by impregnating glass cloth with epoxy-based resin. When the insulating substrate 11 is transparent or translucent, the first coil part 100 and second coil part 200 are seen overlapping each other in a plan view. Thus, outer appearance inspection using an outer appearance inspection device becomes difficult depending on how they overlap each other. Although details will be described later, in the coil component according to the present embodiment, the first and second coil parts 100 and 200 are disposed overlapping each other for the most part in a plan view so as to allow outer appearance inspection using an outer appearance inspection device to be executed properly.

Figure 2:
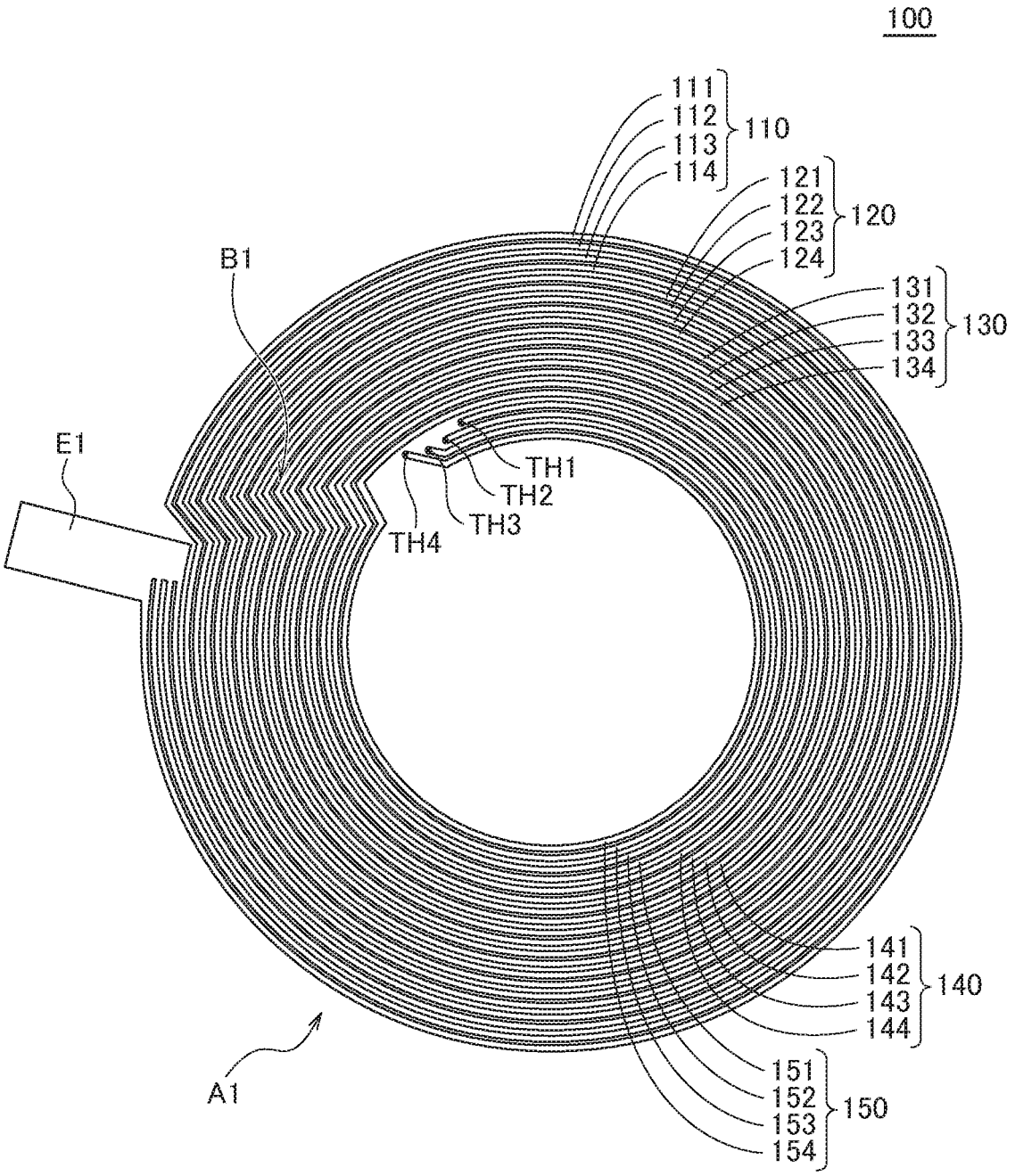
FIG. 2 is a plan view illustrating a pattern shape of a first coil part according to the first embodiment of the present invention.

FIG. 2 is a plan view illustrating a pattern shape of the first coil part 100 as viewed from the surface 11*a* side of the insulating substrate 11.

As illustrated in FIG. 2, the first coil part 100 is constituted of a planar conductor spirally wound in a plurality of turns. In the example of FIG. 2, the first coil part 100 has five turns including turns 110, 120, 130, 140, and 150, in which the turns 110 and 150 are positioned at the outermost and innermost peripheries, respectively. The turns 110, 120, 130, 140, and 150 are each radially separated by three spiral-shaped slits into four sections. Thus, the turns 110, 120, 130, 140, and 150 are separated into conductor parts 111, 121, 131, 141, and 151 positioned at the outermost peripheral side, conductor parts 112, 122, 132, 142, and 152 positioned at the second outermost peripheral side, conductor parts 113, 123, 133, 143, and 153 positioned at the second innermost peripheral side, and conductor parts 114, 124, 134, 144, and 154 positioned at the innermost peripheral side.

The conductor parts 111 to 114 of the turn 110 positioned at the outermost periphery are connected in common to a terminal electrode E1. The conductor parts 151 to 154 of the turn 150 positioned at the innermost periphery are connected respectively to connection parts TH1 to TH4. The turns 110, 120, 130, 140, and 150 constituting the first coil part 100 each have a circumferential region A1 in which the radial position is not changed and a shift region B1 in which the radial position is shifted. The five turns including the turns 110, 120, 130, 140, and 150 are defined with the shift region B1 as a boundary.

Figure 3:
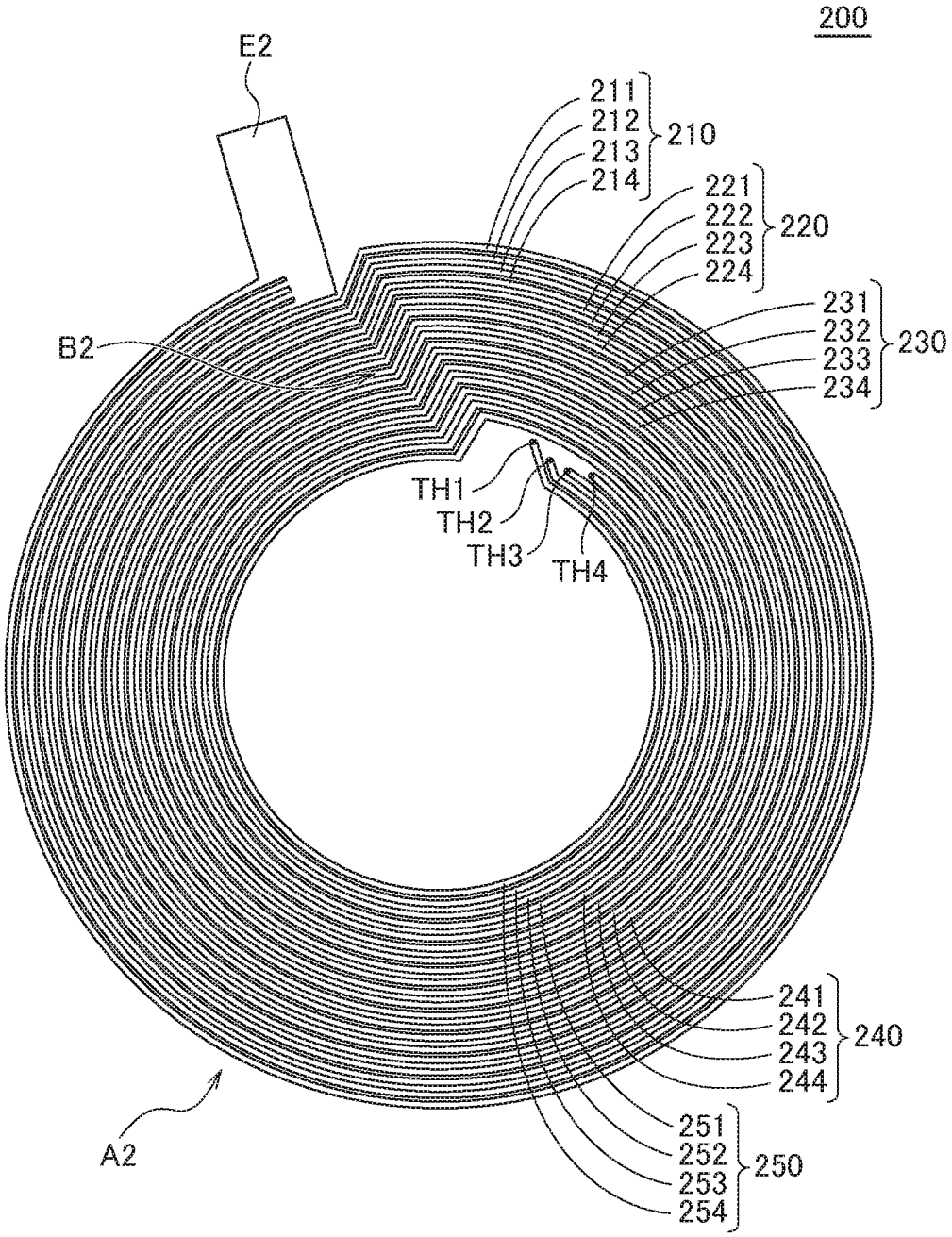
FIG. 3 is a plan view illustrating a pattern shape of a second coil part according to the first embodiment of the present invention.

FIG. 3 is a plan view illustrating the pattern shape of the second coil part 200 as viewed from the surface 11*b* side of the insulating substrate 11.

As illustrated in FIG. 3, the second coil part 200 is constituted of a planar conductor spirally wound in a plurality of turns. In the example of FIG. 3, the second coil part 200 has five turns including turns 210, 220, 230, 240, and 250, in which the turns 210 and 250 are positioned at the outermost and innermost peripheries, respectively. The turns 210, 220, 230, 240, and 250 are each radially separated by three spiral-shaped slits into four sections. Thus, the turns 210, 220, 230, 240, and 250 are separated into conductor parts 211, 221, 231, 241, and 251 positioned at the outermost peripheral side, conductor parts 212, 222, 232, 242, and 252 positioned at the second outermost peripheral side, conductor parts 213, 223, 233, 243, and 253 positioned at the second innermost peripheral side, and conductor parts 214, 224, 234, 244, and 254 positioned at the innermost peripheral side.

The conductor parts 211 to 214 of the turn 210 positioned at the outermost periphery are connected in common to a terminal electrode E2. The conductor parts 251 to 254 of the turn 250 positioned at the innermost periphery are connected respectively to connection parts TH4 to TH1. The turns 210, 220, 230, 240, and 250 constituting the second coil part 200 each have a circumferential region A2 in which the radial position is not changed and a shift region B2 in which the radial position is shifted. The five turns including the turns 210, 220, 230, 240, and 250 are defined with the shift region B2 as a boundary.

Figure 4:
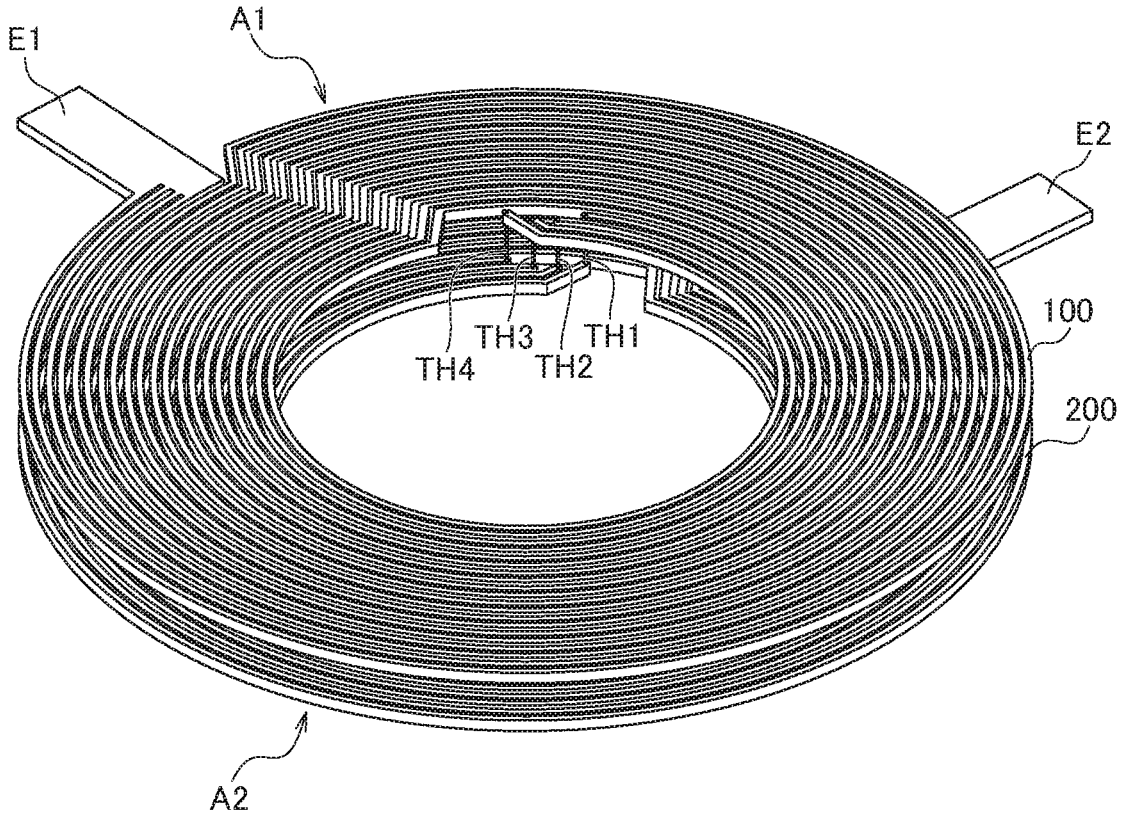
FIG. 4 is a schematic perspective view of the first and second coil parts according to the first embodiment of the present invention.
Figure 5:
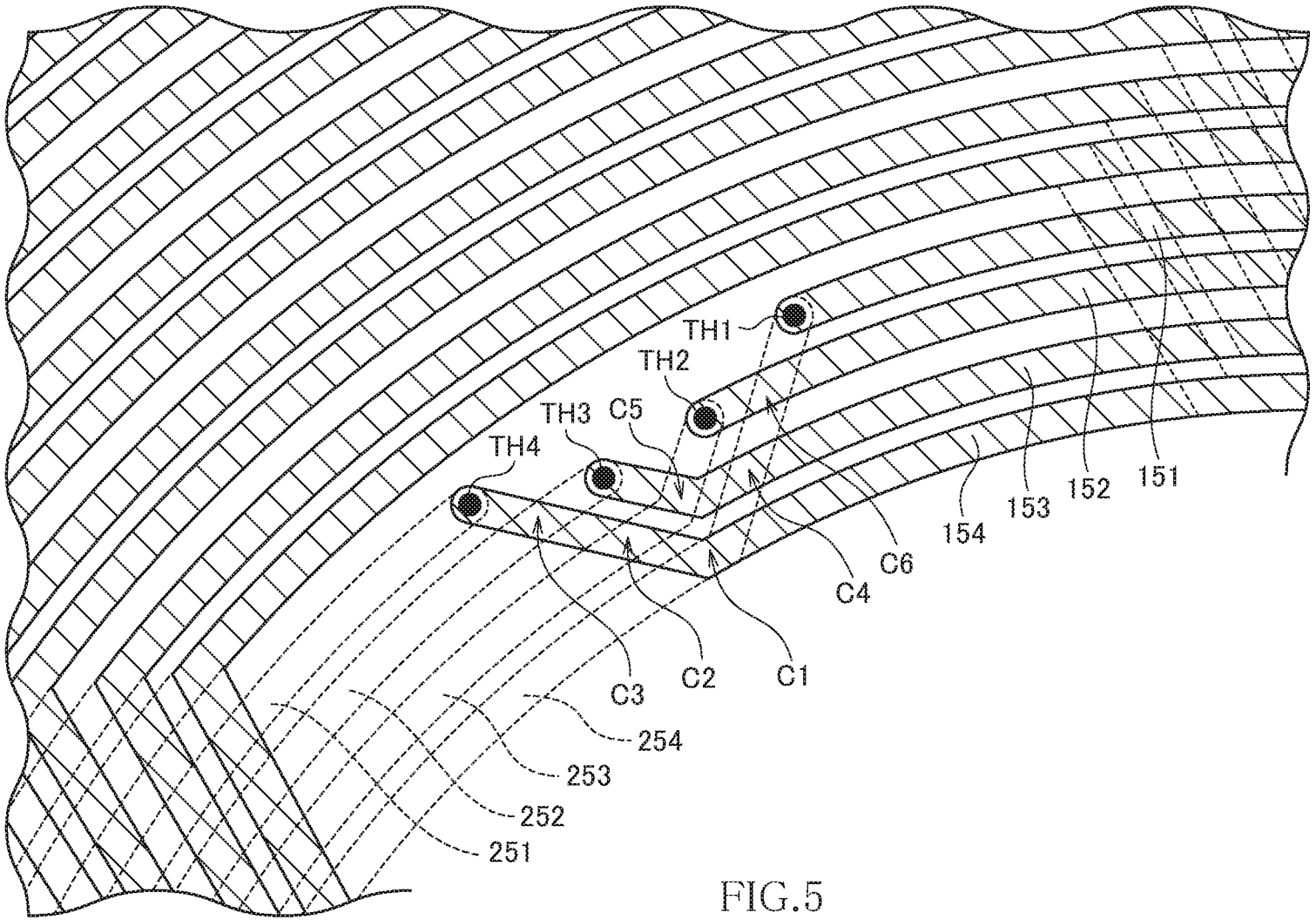
FIG. 5 is an enlarged transparent view illustrating the layout of the connection parts according to the first embodiment of the present invention.

FIG. 4 is a schematic perspective view of the first and second coil parts 100 and 200, and FIG. 5 is an enlarged transparent view illustrating the layout of the connection parts TH1 to TH4.

As illustrated in FIG. 4, the first and second coil parts 100 and 200 are laid out such that the circumferential regions A1 and circumferential regions A2 substantially coincide with each other in planar position. Specifically, the first and second coil parts 100 and 200 are laid out such that the circumferential regions A1 of the turns 110, 120, 130, 140, and 150 constituting the first coil part 100 overlap the circumferential regions A2 of the turns 210, 220, 230, 240, and 250 constituting the second coil part 200, respectively.

As illustrated in FIG. 5, the inner peripheral ends of the conductor parts 151, 152, 153, and 154 constituting the turn 150 of the first coil part 100 are connected respectively to the inner peripheral ends of the conductor parts 254, 253, 252, and 251 constituting the turn 250 of the second coil part 200 through the connection parts TH1, TH2, TH3, and TH4. More specifically, the conductor part 151 positioned at the outermost peripheral side is connected to the conductor part 254 positioned at the innermost peripheral side, the conductor part 152 positioned at the second outermost peripheral side is connected to the conductor part 253 positioned at the second innermost peripheral side, the conductor part 153 positioned at the second innermost peripheral side is connected to the conductor part 252 positioned at the second outermost peripheral side, and the conductor part 154 positioned at the innermost peripheral side is connected to the conductor part 251 positioned at the outermost peripheral side. As a result, the conductor parts 111, 121, 131, 141, and 151 of the first coil part 100 are connected to the conductor parts 214, 224, 234, 244, and 254 of the second coil part 200, the conductor parts 112, 122, 132, 142, and 152 of the first coil part 100 are connected to the conductor parts 213, 223, 233, 243, and 253 of the second coil part 200, the conductor parts 113, 123, 133, 143, and 153 of the first coil part 100 are connected to the conductor parts 212, 222, 232, 242, and 252 of the second coil part 200, and the conductor parts 114, 124, 134, 144, and 154 of the first coil part 100 are connected to the conductor parts 211, 221, 231, 241, and 251 of the second coil part 200.

Figure 6:
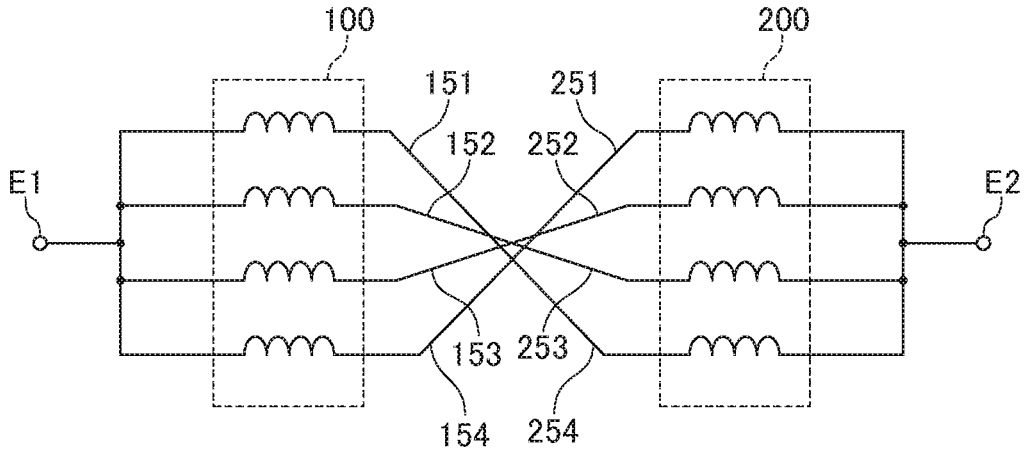
FIG. 6 is an equivalent circuit diagram of the coil component according to the first embodiment of the present invention.

As a result, the first and second coil parts 100 and 200 are connected in series to each other as illustrated in FIG. 6, thereby constituting a spiral coil of 10 turns in total.

As described above, in the coil component according to the present embodiment, each turn is radially separated by the spiral-shaped slits into four sections, so that non-uniformity of current density is reduced as compared to a case where such a slit is not formed. As a result, DC resistance or AC resistance can be reduced. In addition, the radial positions of the conductor parts are completely interchanged between the first and second coil parts 100 and 200, thereby canceling the inner/outer peripheral difference. This further uniformizes current density distribution, allowing further reduction in DC resistance or AC resistance.

Further, the first and second coil parts 100 and 200 overlap each other for the most part in a plan view excluding the shift regions B1 and B2, so that even when the insulating substrate 11 is transparent or translucent, visual interference between the first and second coil parts 100 and 200 can be minimized. That is, when the outer appearance of the first coil part 100 is inspected, the second coil part 200 does not function as visual obstruction and, conversely, when the outer appearance of the second coil part 200 is inspected, the first coil part 100 does not function as visual obstruction. This allows outer appearance inspection using an outer appearance inspection device to be executed properly.

Figure 7:
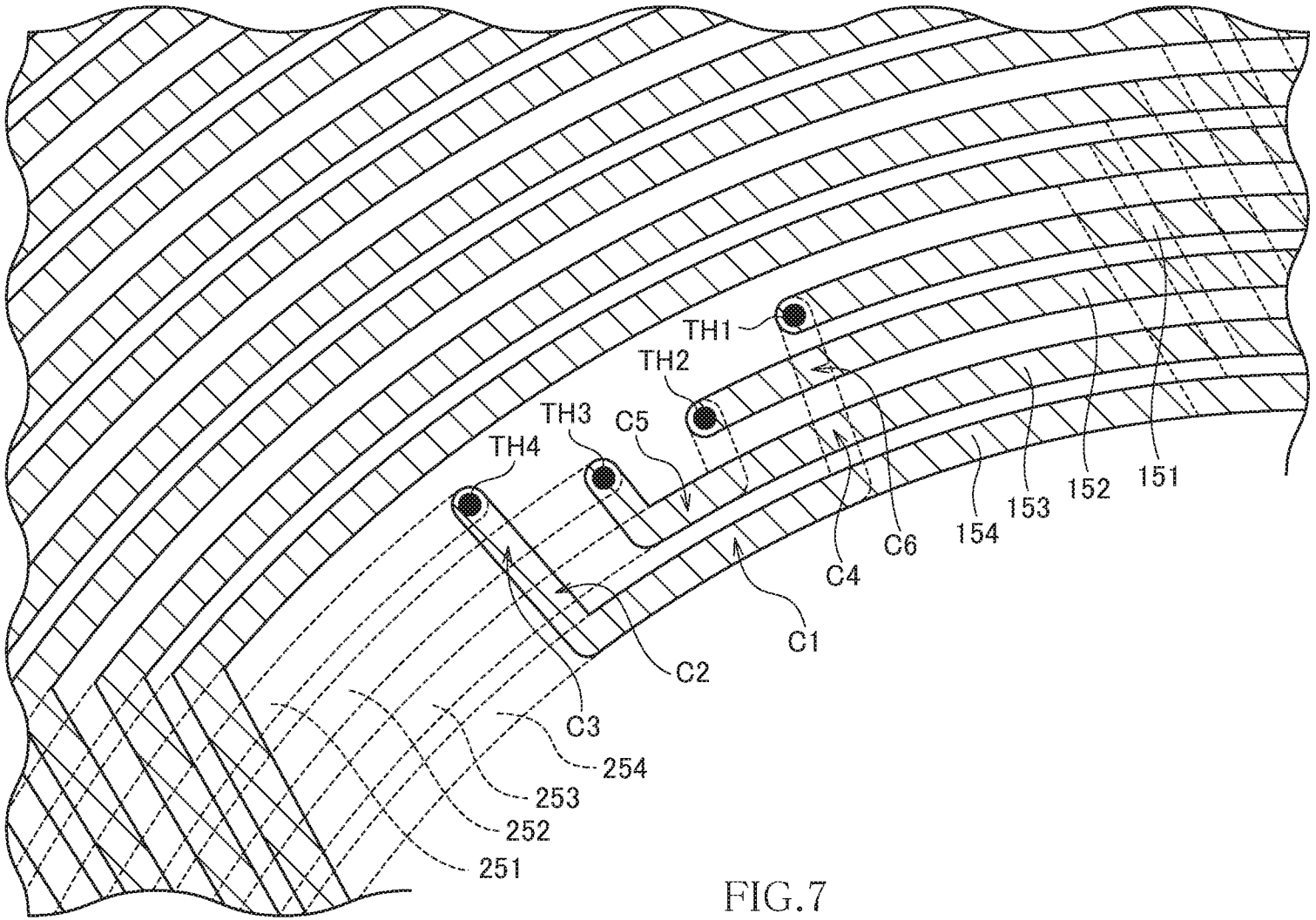
FIG. 7 is an enlarged transparent view illustrating another possible layout of the connection parts.

In the layout illustrated in FIG. 5, the conductor part 154 crosses the conductor parts 254, 253, and 252 at crossing regions C1, C2, and C3, the conductor part 153 crosses the conductor parts 254 and 253 at crossing regions C4 and C5, and the conductor part 152 crosses the conductor part 254 at a crossing region C6. However, at the crossing regions C1 and C5, the corresponding conductor parts need not cross each other at a predetermined angle, but as illustrated in the modification of FIG. 7, they may extend in the peripheral direction overlapping each other. In the example of FIG. 7, the conductor parts 154 and 254 extend in the peripheral direction overlapping each other at the crossing region C1, and the conductor parts 153 and 253 extend in the peripheral direction overlapping each other at the crossing region C5.

In the present embodiment, all the turns 110, 120, 130, 140, and 150 and 210, 220, 230, 240, and 250 constituting the first and second coil parts 100 and 200 are each radially separated into four sections; however, it is not essential to radially separate all the turns in the present invention, but it is sufficient to radially separate at least the inner peripheral ends of the turns 150 and 250 positioned at the innermost peripheries. Therefore, some turns may not be radially separated. However, when all the turns 110, 120, 130, 140, and 150 and 210, 220, 230, 240, and 250 constituting the first and second coil parts 100 and 200 are radially separated into four sections as in the present embodiment, current density distribution can be further uniformized to make it possible to further reduce DC resistance or AC resistance.

Further, while the turns constituting the first and second coil parts 100 and 200 are each radially separated into four sections in the present embodiment, the number of separations is not particularly limited as long as it is three or more. This is because the current density distribution is made more uniform as the number of separations becomes larger. However, increase in the number of separations increases the occupancy area of the slit, so that the conductor area per one turn is reduced, which may increase DC resistance. Considering this point, the number of separations is preferably set to four to eight. The actual number of separations may be determined by the frequency of current flowing through the coil component, and it is preferable to reduce the number of separations as the frequency band becomes low and to increase the number of separations as the frequency band becomes high. In particular, when the coil component according to the present invention is used as a receiving coil for a wireless power transmission system, the frequency of AC power to receive may be 30 kHz to 150 kHz. In this case, the optimum number of separations may be four.

Figure 8:
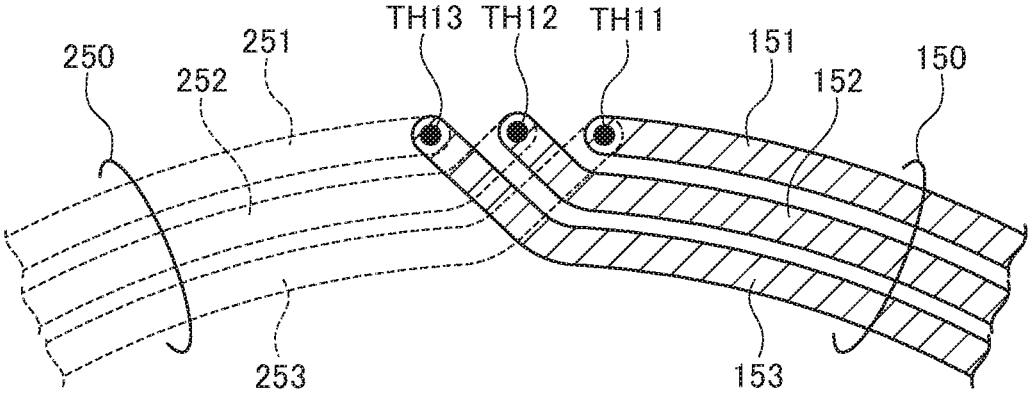
FIG. 8 is a schematic view illustrating an example of a method of connecting the turns when the number of separations is set to three.

FIG. 8 is a schematic view illustrating an example of a method of connecting the turns 150 and 250 when the number of separations is set to three.

In the example of FIG. 8, the turns constituting the first and second coil parts 100 and 200 are each separated into three sections, whereby the turn 150 positioned at the innermost periphery is separated into three conductor parts 151 to 153, and the turn 250 positioned at the innermost periphery is separated into three conductor parts 251 to 253. In this case, the inner peripheral end of the conductor part 151 constituting the turn 150 and positioned at the outermost peripheral side is connected to the inner peripheral end of the conductor part 253 constituting the turn 250 and positioned at the innermost peripheral side through a connection part TH11, the inner peripheral end of the conductor part 152 constituting the turn 150 and positioned at the radially intermediate position is connected to the inner peripheral end of the conductor part 252 constituting the turn 250 and positioned at the radially intermediate position through a connection part TH12, and the inner peripheral end of the conductor part 153 constituting the turn 150 and positioned at the innermost peripheral side is connected to the inner peripheral end of the conductor part 251 constituting the turn 250 and positioned at the outermost peripheral side through a connection part TH13. As a result, the radial positions of the conductor parts are completely interchanged between the first and second coil parts 100 and 200.

Figure 9:
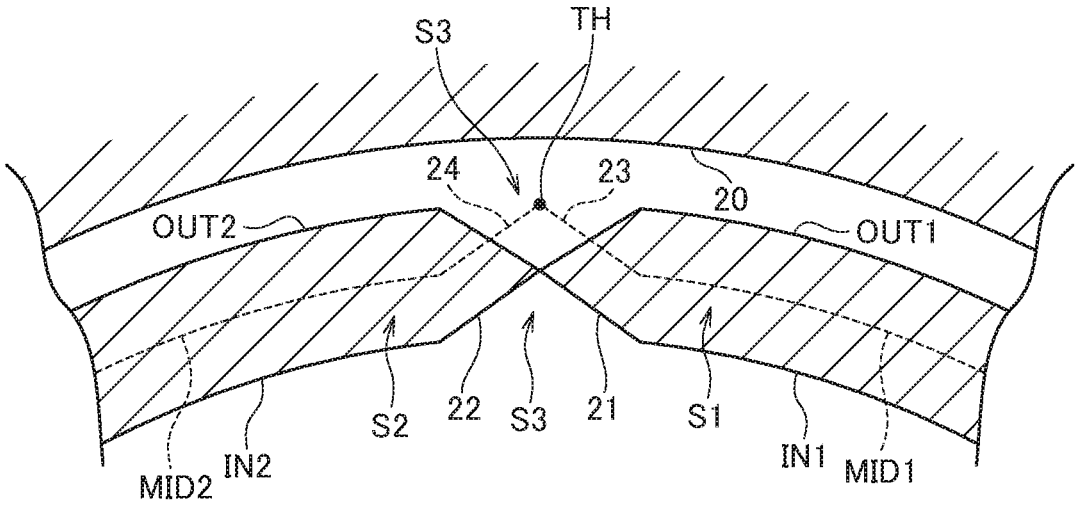
FIG. 9 is a schematic view illustrating a generalized layout when the number of separations is set to three or four.

FIG. 9 is a schematic view illustrating a generalized layout when the number of separations is set to three or four.

In FIG. 9, conductor parts IN1 and OUT1 correspond respectively to a conductor part (e.g., conductor part 154) positioned at the innermost peripheral side and a conductor part (e.g., conductor part 151) positioned at the outermost peripheral side which are included in three or four conductor parts constituting the innermost turn of one coil part (e.g., the first coil part 100). A conductor part MID1 corresponds to a conductor part (e.g., conductor part 152 or 153) other than those positioned at the innermost and outermost peripheral sides which are included in three or four conductor parts constituting the innermost turn of the one coil part. Similarly, conductor parts IN2 and OUT2 correspond respectively to a conductor part (e.g., conductor part 254) positioned at the innermost peripheral side and a conductor part (e.g., conductor part 251) positioned at the outermost peripheral side which are included in three or four conductor parts constituting the innermost turn of the other coil part (e.g., the second coil part 200). A conductor part MID2 corresponds to a conductor part (e.g., conductor part 252 or 253) other than those positioned at the innermost and outermost peripheral sides which are included in three or four conductor parts constituting the innermost turn of the other coil part.

The conductor part IN1 and the conductor part OUT2 are connected to each other through a conductor part 21, and the conductor part OUT1 and the conductor part IN2 are connected to each other through a conductor part 22. The conductor part 21 is constituted by one of the conductor parts IN1 and OUT2, and the conductor part 22 is constituted by one of the conductor parts OUT1 and IN2. Since the conductor parts 21 and 22 cross each other, they need to be positioned on the front and back sides of the insulating substrate. Therefore, when the conductor part 21 is constituted by the conductor part IN1, the conductor part 22 is constituted by the conductor part IN2, and when the conductor part 21 is constituted by the conductor part OUT2, the conductor part 22 is constituted by the conductor part OUT1.

In the above layout, a region S1 surrounded by the conductor parts IN1, OUT1 and conductor parts 21, 22 is defined, and a region S2 surrounded by the conductor parts IN2, OUT2 and conductor parts 21, 22 is defined. The conductor parts MID1 and MID2 cannot be connected to each other at a position overlapping the region S1 or S2 in a plan view and thus need to be connected in a region S3 different from the regions S1 and S2 in a plan view. That is, a conductor part 23 connected to the conductor part MID1 and a conductor part 24 connected to the conductor part MID2 are connected to each other through the connection part TH disposed in the region S3. The conductor part 23 is positioned in the same layer as the conductor part 21 and in the different layer from the conductor part 22. The conductor part 24 is positioned in the same layer as the conductor part 22 and in the different layer from the conductor part 21.

The region S3 is formed on the inner and outer peripheral sides as viewed from the crossing point between the conductor parts 21 and 22. However, when the connection part TH is disposed at the outer peripheral side as viewed from the crossing point between the conductor parts 21 and 22 as illustrated in FIG. 9, the connection part TH needs to be disposed at the inner peripheral side relative to the conductor part 20 which is the innermost conductor part of the adjacent turn so as to avoid interference with the conductor part 20.

As described above, when the number of separations of each turn is set to three or four, the connection part TH is disposed in the region S3. This allows the conductor parts MID1 and MID2 to be connected to each other by the conductor parts 23 and 24 without interference with the conductor parts IN1, OUT1, IN2, OUT2, 21 and 22.

Figure 10:
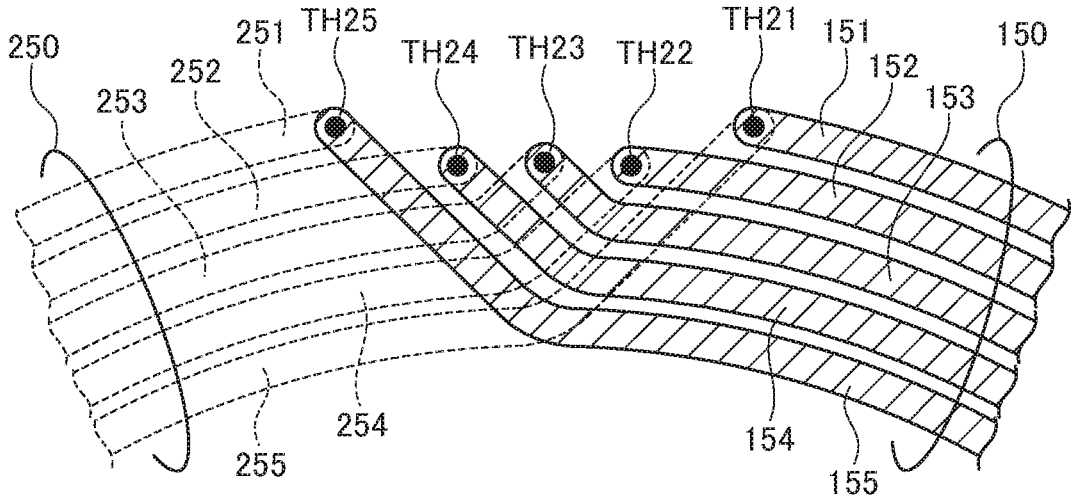
FIG. 10 is a schematic view illustrating an example of a method of connecting the turns when the number of separations is set to five.

FIG. 10 is a schematic view illustrating an example of a method of connecting the turns 150 and 250 when the number of separations is set to five.

In the example of FIG. 10, the turns constituting the first and second coil parts 100 and 200 are each separated into five sections, whereby the turn 150 positioned at the innermost periphery is separated into five conductor parts 151 to 155, and the turn 250 positioned at the innermost periphery is separated into five conductor parts 251 to 255. In this case, the inner peripheral end of the conductor part 151 constituting the turn 150 and positioned at the outermost peripheral side is connected to the inner peripheral end of the conductor part 255 constituting the turn 250 and positioned at the innermost peripheral side through a connection part TH21, the inner peripheral end of the conductor part 152 constituting the turn 150 and positioned at the second outermost peripheral side is connected to the inner peripheral end of the conductor part 254 constituting the turn 250 and positioned at the second innermost peripheral side through a connection part TH22, the inner peripheral end of the conductor part 153 constituting the turn 150 and positioned at the radially intermediate position is connected to the inner peripheral end of the conductor part 253 constituting the turn 250 and positioned at the radially intermediate position through a connection part TH23, the inner peripheral end of the conductor part 154 constituting the turn 150 and positioned at the second innermost peripheral side is connected to the inner peripheral end of the conductor part 252 constituting the turn 250 and positioned at the second outermost peripheral side through a connection part TH24, and the inner peripheral end of the conductor part 155 constituting the turn 150 and positioned at the innermost peripheral side is connected to the inner peripheral end of the conductor part 251 constituting the turn 250 and positioned at the outermost peripheral side through a connection part TH25. As a result, the radial positions of the conductor parts are completely interchanged between the first and second coil parts 100 and 200.

Figure 11:
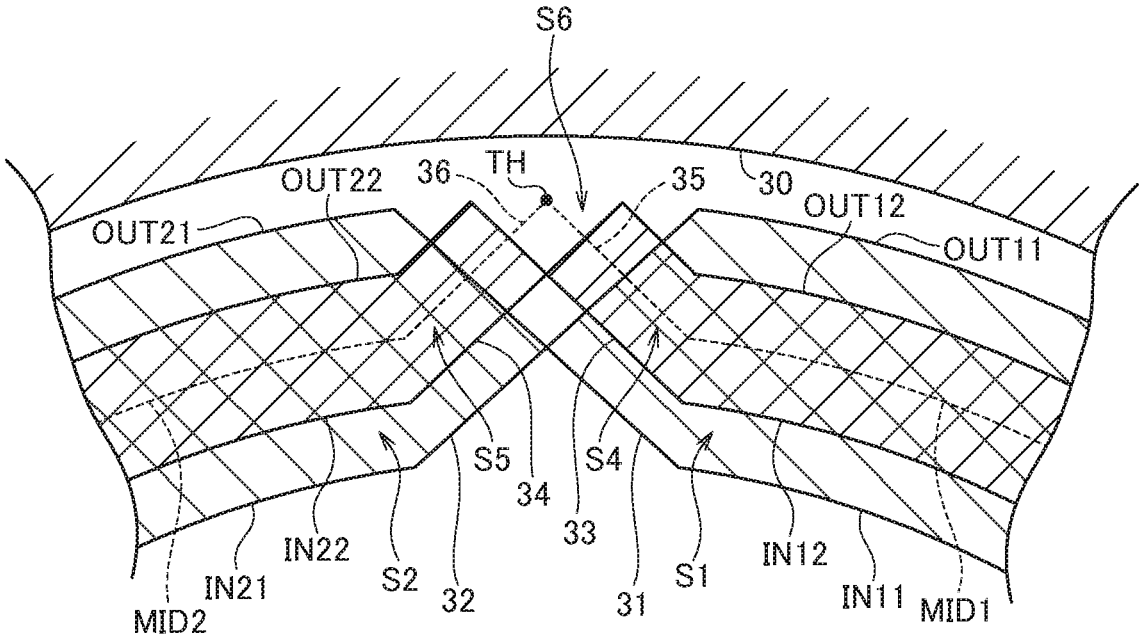
FIG. 11 is a schematic view illustrating a generalized layout when the number of separations is set to five or more.

FIG. 11 is a schematic view illustrating a generalized layout when the number of separations is set to five or more.

In FIG. 11, conductor parts IN11 and OUT11 correspond respectively to a conductor part (e.g., conductor part 155) positioned at the innermost peripheral side and a conductor part (e.g., conductor part 151) positioned at the outermost peripheral side which are included in five or more conductor parts constituting the innermost turn of one coil part (e.g., the first coil part 100). Conductor parts IN12 and OUT12 correspond respectively to a conductor part (e.g., conductor part 154) positioned at the second innermost peripheral side and a conductor part (e.g., conductor part 152) positioned at the second outermost peripheral side which are included in five or more conductor parts constituting the innermost turn of the one coil part. A conductor part MID1 corresponds to a conductor part (e.g., conductor part 153) other than those mentioned above which are included in five or more conductor parts constituting the innermost turn of the one coil part. Similarly, conductor parts IN21 and OUT21 correspond respectively to a conductor part (e.g., conductor part 255) positioned at the innermost peripheral side and a conductor part (e.g., conductor part 251) positioned at the outermost peripheral side which are included in five or more conductor parts constituting the innermost turn of the other coil part (e.g., the second coil part 200). Conductor parts IN22 and OUT22 correspond respectively to a conductor part (e.g., conductor part 254) positioned at the second innermost peripheral side and a conductor part (e.g., conductor part 252) positioned at the second outermost peripheral side which are included in five or more conductor parts constituting the innermost turn of the other coil part. A conductor part MID2 corresponds to a conductor part (e.g., conductor part 253) other than those mentioned above which are included in five or more conductor parts constituting the innermost turn of the other coil part.

The conductor part IN11 and the conductor part OUT21 are connected to each other through a conductor part 31, and the conductor part OUT11 and the conductor part IN21 are connected to each other through a conductor part 32. The conductor part 31 is constituted by one of the conductor parts IN11 and OUT21, and the conductor part 32 is constituted by one of the conductor parts OUT11 and IN21. Since the conductor parts 31 and 32 cross each other, they need to be positioned on the front and back sides of the insulating substrate. Therefore, when the conductor part 31 is constituted by the conductor part IN11, the conductor part 32 is constituted by the conductor part IN21, and when the conductor part 31 is constituted by the conductor part OUT21, the conductor part 32 is constituted by the conductor part OUT11.

The conductor part IN12 and the conductor part OUT22 are connected to each other through a conductor part 33, and the conductor part OUT12 and the conductor part IN22 are connected to each other through a conductor part 34. The conductor part 33 is constituted by one of the conductor parts IN12 and OUT22, and the conductor part 34 is constituted by one of the conductor parts OUT12 and IN22. Since the conductor parts 33 and 34 cross each other, they need to be positioned on the front and back sides of the insulating substrate. In addition, interference with the conductor parts 31 and 32 needs to be avoided. Therefore, when the conductor parts 31 and 32 are constituted by the conductor parts IN11 and IN21, respectively, the conductor parts 33 and 34 are constituted by the conductor parts IN12 and IN22, respectively, and when the conductor parts 31 and 32 are constituted by the conductor parts OUT21 and OUT11, respectively, the conductor parts 33 and 34 are constituted by the conductor parts OUT22 and OUT21, respectively.

In the above layout, a region S1 surrounded by the conductor parts IN11, OUT11 and conductor parts 31, 32 is defined, and a region S2 surrounded by the conductor parts IN21, OUT21 and conductor parts 31, 32 is defined. Further, a region S4 surrounded by the conductor parts IN12, OUT12 and conductor parts 33, 34 is defined, and a region S5 surrounded by the conductor parts IN22, OUT22 and conductor parts 33, 34 is defined. The conductor parts MID1 and MID2 cannot be connected to each other at a position overlapping the region S1, S2, S4, or S5 in a plan view and thus need to be connected in a region S6 different from the regions S1, S2, S4, and S5 in a plan view. That is, a conductor part 35 connected to the conductor part MID1 and a conductor part 36 connected to the conductor part MID2 are connected to each other through the connection part TH disposed in the region S6. The conductor part 35 is positioned in the same layer as the conductor parts 31 and 33 and in a layer different from the conductor parts 32 and 34. The conductor part 36 is positioned in the same layer as the conductor parts 32 and 34 and in a layer different from the conductor parts 31 and 33.

The region S6 is formed on the inner and outer peripheral sides as viewed from the crossing point between the conductor parts 31 and 32. However, when the connection part TH is disposed at the outer peripheral side as viewed from the crossing point between the conductor parts 31 and 32 as illustrated in FIG. 11, the connection part TH needs to be disposed at the inner peripheral side relative to the conductor part 30 which is the innermost conductor part of the adjacent turn so as to avoid interference with the conductor part 30.

As described above, when the number of separations of each turn is set to five or more, the connection part TH is disposed in the region S6. This allows the conductor parts MID1 and MID2 to be connected to each other by the conductor parts 35 and 36 without interference with the conductor parts IN11, OUT11, IN12, OUT12, IN21, OUT21, IN22, OUT22, 31 to 34.

Figure 12:
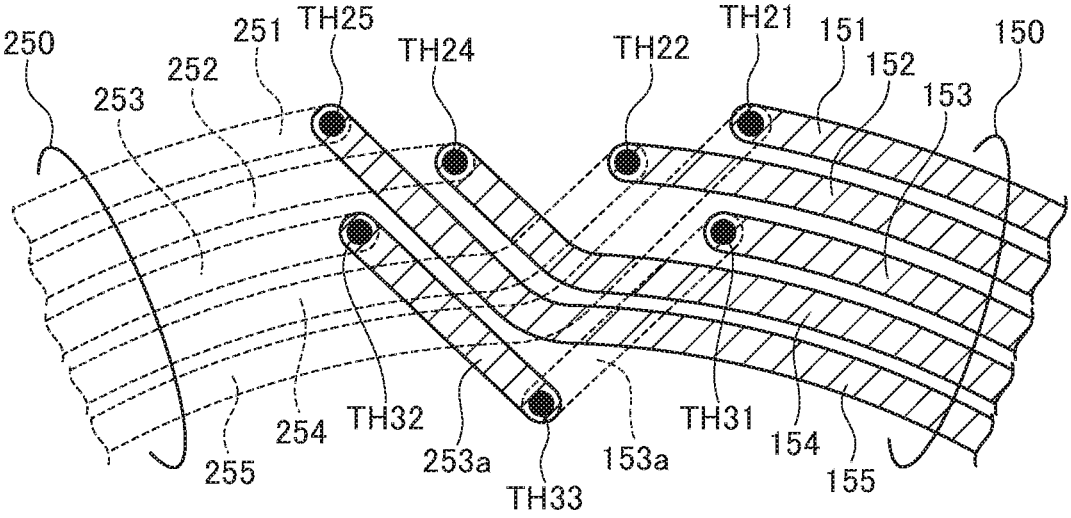
FIG. 12 is a schematic view illustrating another example of the method of connecting the turns when the number of separations is set to five.

FIG. 12 is a schematic view illustrating another example of the method of connecting the turns 150 and 250 when the number of separations is set to five.

In the example of FIG. 12, conductor parts 153*a* and 253*a* are additionally provided. The conductor parts 153 and 153*a* are connected to each other through a connection part TH31, conductor parts 253 and 253*a* are connected to each other through a connection part TH32, and conductor parts 153*a* and 253*a* are connected to each other through a connection part TH33. The conductor parts 151 to 155 and 253*a* are formed on one surface of the insulating substrate, and conductor parts 251 to 255 and 153*a* are formed on the other surface of the insulating substrate. Also in this layout, the radial positions of the conductor parts are completely interchanged between the first and second coil parts 100 and 200. The layout of FIG. 10 is advantageous over the layout of FIG. 12 in that the number of the connection parts necessary can be minimized (in this case, five). On the other hand, in the layout of FIG. 12, the connection parts TH33 can be disposed on the side opposite to the connection parts TH22 and TH24 as viewed from the crossing point between the conductor parts 155 and 255, allowing the positions of a plurality of the connection parts to be further distributed.

Second Embodiment

Next, a coil component according to a second embodiment will be described. The coil component according to the second embodiment differs from the coil component according to the first embodiment in that the first and second coil parts 100 and 200 are replaced by a first coil part 100A illustrated in FIG. 13 and a second coil part 200A illustrated in FIG. 14, respectively.

Figure 13:
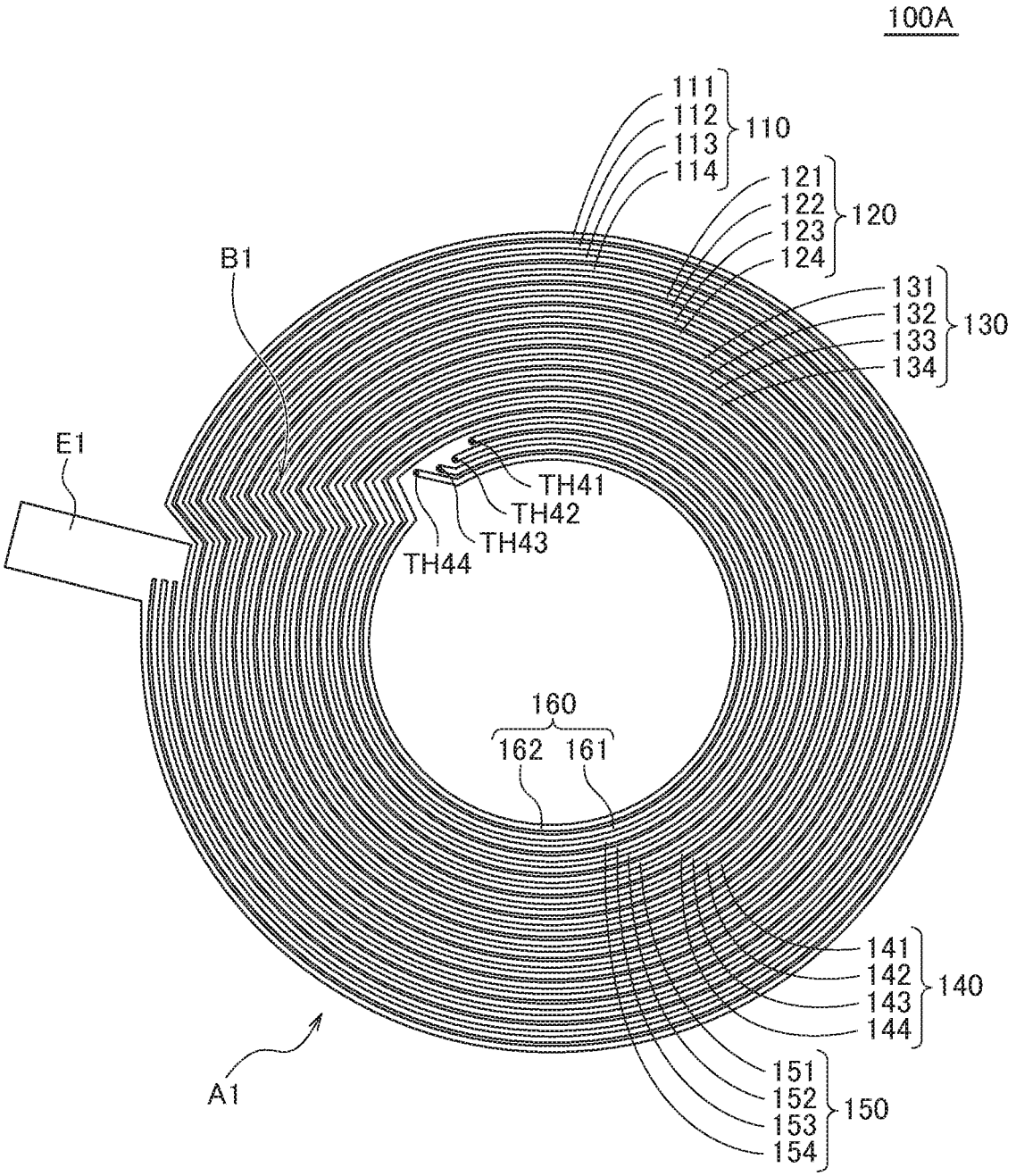
FIG. 13 is a plan view illustrating a pattern shape of the first coil part according to a second embodiment of the present invention.

As illustrated in FIG. 13, the first coil part 100A differs from the first coil part 100 illustrated in FIG. 2 in that a turn 160 constituted of conductor parts 161 and 162 are added to the inner peripheral part. The conductor part 161 is a conductor part obtained by extending the conductor part 151 constituting the turn 150 by one turn. The conductor part 162 is a conductor part obtained by extending the conductor part 152 constituting the turn 150 by one turn.

Figure 14:
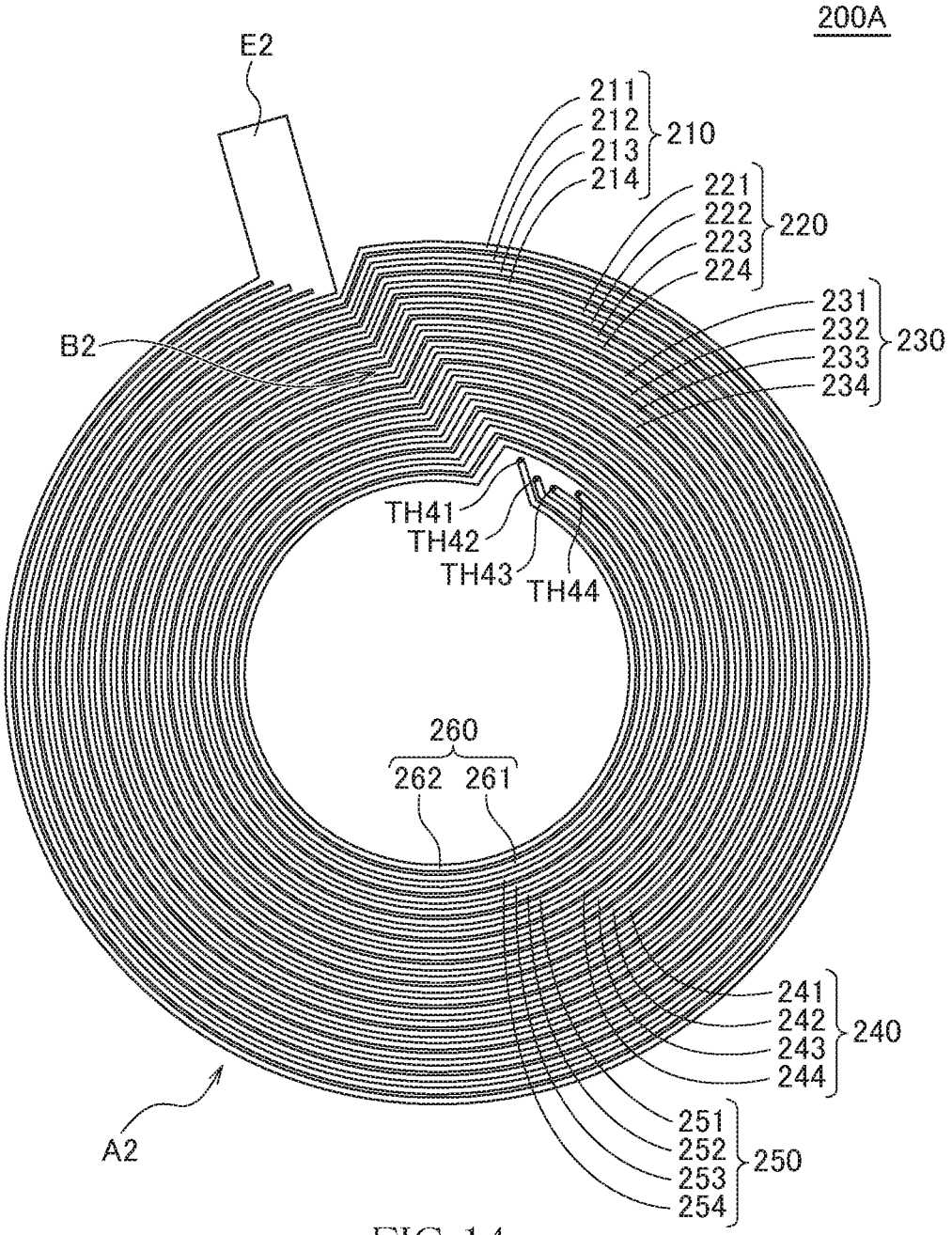
FIG. 14 is a plan view illustrating a pattern shape of the second coil part according to the second embodiment of the present invention.

As illustrated in FIG. 14, the second coil part 200A differs from the second coil part 200 illustrated in FIG. 3 in that a turn 260 constituted of conductor parts 261 and 262 is added to the inner peripheral part. The conductor part 261 is a conductor part obtained by extending the conductor part 251 constituting the turn 250 by one turn. The conductor part 262 is a conductor part obtained by extending the conductor part 252 constituting the turn 250 by one turn.

Figure 15:
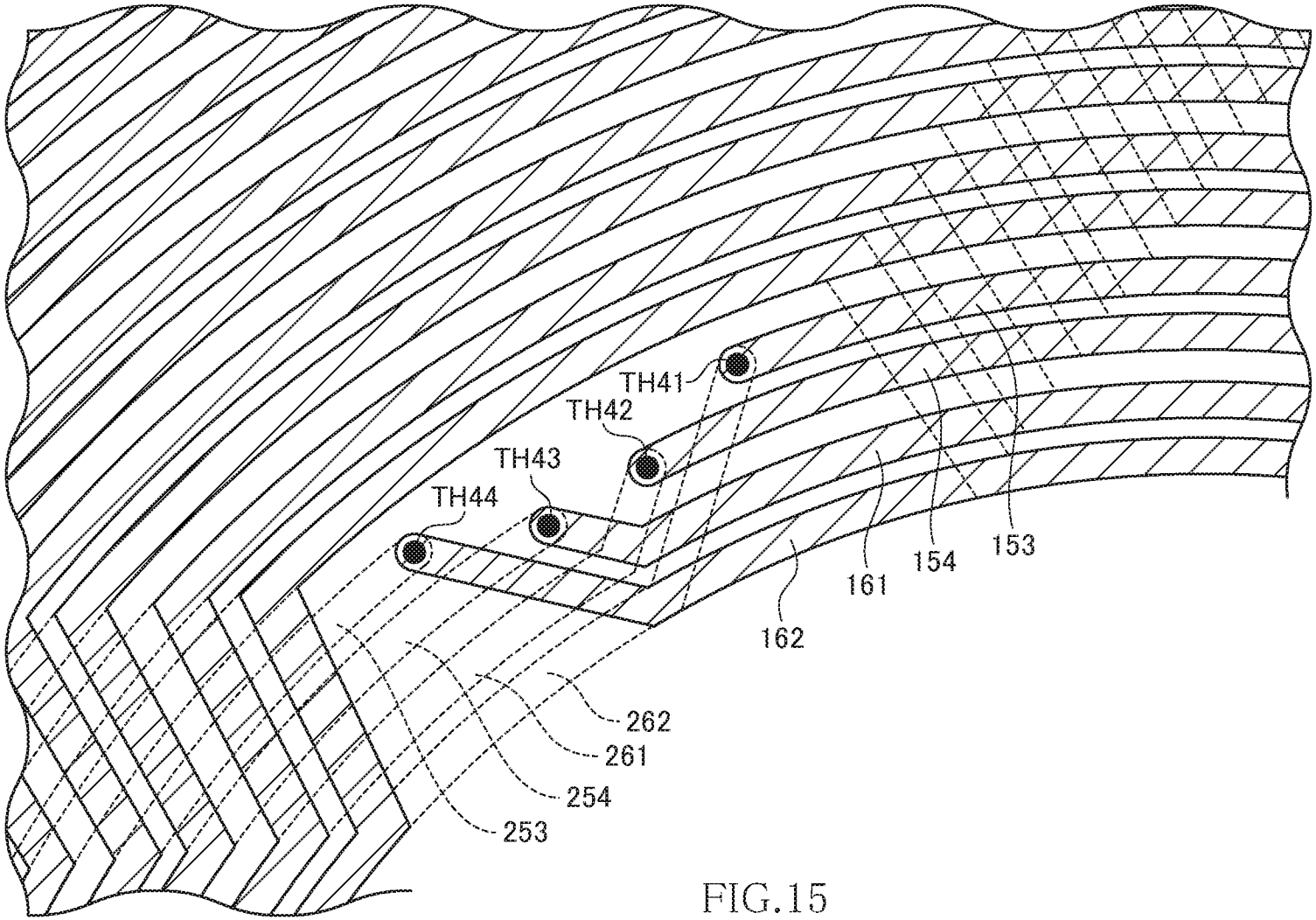
FIG. 15 is an enlarged transparent view illustrating the layout of the connection parts according to the second embodiment of the present invention.
Figure 16:
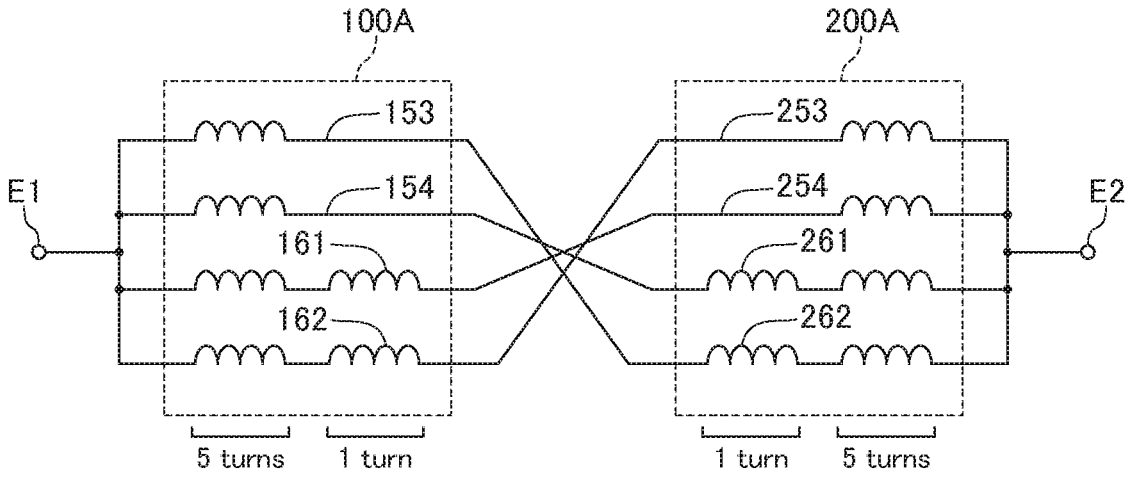
FIG. 16 is an equivalent circuit diagram of the coil component according to the second embodiment of the present invention.

As illustrated in FIG. 15, the inner peripheral ends of the conductor parts 153, 154, 161, and 162 of the first coil part 100A are connected respectively to the inner peripheral ends of the conductor parts 262, 261, 254, and 253 of the second coil part 200A through connection parts TH41, TH42, TH43, and TH44. As a result, the first and second coil parts 100A and 200A are connected in series to each other as illustrated in FIG. 16, thereby constituting a spiral coil of 11 turns in total.

As described above, in the coil component according to the present embodiment, each turn is radially separated by the spiral-shaped slits into four sections, and two conductor parts are each extended by one turn, so that it is possible to realize a spiral coil of an odd number of turns in total.

It is apparent that the present invention is not limited to the above embodiments, but may be modified and changed without departing from the scope and spirit of the invention.

What is claimed is:

1. A coil component comprising:

an insulating substrate having first and second surfaces opposite to each other;

a first coil part formed on the first surface of the insulating substrate, the first coil part being spirally wound in a plurality of turns; and a second coil part formed on the second surface of the insulating substrate, the second coil part being spirally wound in a plurality of turns, wherein at least an innermost turn of the first coil part is radially separated by spiral-shaped slits into three or more conductor parts, wherein at least an innermost turn of the second coil part is radially separated by spiral-shaped slits into three or more conductor parts, and wherein inner peripheral ends of respective innermost to outermost conductor parts of the three or more conductor parts of the first coil part are connected to inner peripheral ends of the respective outermost to innermost conductor parts of the three or more conductor parts of the second coil part.

2. The coil component as claimed in claim 1, wherein the three or more conductor parts of the first coil include a first conductor part positioned at an innermost peripheral side and a third conductor part positioned at an outermost peripheral side, wherein the three or more conductor parts of the second coil include a fourth conductor part positioned at an innermost peripheral side and a second conductor part positioned at an outermost peripheral side, wherein the first and second conductor parts are connected to each other, wherein the third and fourth conductor parts are connected to each other, wherein the first and fourth conductor parts or the second and third conductor parts overlap each other in a plan view, thereby a first region surrounded in a plan view by the first conductor part, the third conductor part, and the second or fourth conductor part is defined, and a second region surrounded in a plan view by the second conductor part, the fourth conductor part, and the first or third conductor part is defined, and wherein a conductor part included in the three or more conductor parts of the first coil part other than the first and third conductor parts is connected to a conductor part included in the three or more conductor parts of the second coil part other than the second and fourth conductor parts in a third region different from the first and second regions in a plan view.

3. The coil component as claimed in claim 2, wherein the innermost turn of the first coil part is separated into three conductor parts including the first conductor part, the third conductor part, and fifth conductor part, wherein the innermost turn of the second coil part is separated into three conductor parts including the second conductor part, the fourth conductor part, and sixth conductor part, and wherein the fifth and sixth conductor parts are connected in the third region.

4. The coil component as claimed in claim 2, wherein the innermost turn of the first coil part has a fifth conductor part and a seventh conductor part positioned between the third and fifth conductor parts, wherein the innermost turn of the second coil part has a sixth conductor part and an eighth conductor part positioned between the fourth and sixth conductor parts, wherein the fifth and sixth conductor parts are connected to each other in the third region, and wherein the seventh and eighth conductor parts are connected to each other in the third region.

5. The coil component as claimed in claim 4, wherein at least the innermost turn of the first coil part has a ninth conductor part positioned between the fifth and seventh conductor parts, wherein at least the innermost turn of the second coil part has a tenth conductor part positioned between the sixth and eighth conductor parts, wherein the fifth and eighth conductor parts or the sixth and seventh conductor parts overlap each other in a plan view, thereby a fourth region surrounded in a plan view by the fifth conductor part, seventh conductor part, and sixth or eighth conductor part is defined, and a fifth region surrounded in a plan view by the sixth conductor part, eighth conductor part, and fifth or seventh conductor part is defined, and wherein the ninth conductor part is connected to the tenth conductor part in a sixth region different from the first, second, fourth, and fifth regions in a plan view.

6. The coil component as claimed in claim 4, wherein each of the turns constituting the first coil part including the innermost turn thereof is separated into at least the first, third, fifth, and seventh conductor parts by slits, and wherein each of the turns constituting the second coil part including the innermost turn thereof is separated into at least the second, fourth, sixth, and eighth conductor parts by slits.

7. The coil component as claimed in claim 6, wherein a number of turns of each of the third and seventh conductor parts is larger by one turn than a number of turns of each of the first and fifth conductor parts, and wherein a number of turns of each of the second and sixth conductor parts is larger by one turn than a number of turns of each of the fourth and eighth conductor parts.

8. The coil component as claimed in claim 1, wherein each of the first and second coil parts has a circumferential region in which a radial position is not changed and a shift region in which the radial position is changed.

9. The coil component as claimed in claim 8, wherein the circumferential regions of the first coil part and the circumferential regions of the second coil part coincide with each other in planar position.

10. The coil component as claimed in claim 9, wherein the insulating substrate is transparent or translucent.

11. A coil component comprising:

an insulating substrate having first and second surfaces opposite to each other;

a first spiral coil formed on the first surface of the insulating substrate, the first spiral coil having an innermost turn that is radially separated by spiral-shaped slits into at least first, second, and third lines;

a second spiral coil formed on the second surface of the insulating substrate, the second spiral coil having an innermost turn that is radially separated by spiral-shaped slits into at least fourth, fifth, and sixth lines; and first, second, and third through conductors penetrating through the insulating substrate, wherein the first line of the first spiral coil is connected to the sixth line of the second spiral coil, wherein the second line of the first spiral coil is connected to the fifth line of the second spiral coil, and wherein the third line of the first spiral coil is connected to the fourth line of the second spiral coil.

12. The coil component as claimed in claim 11, wherein the third line of the first spiral coil crosses the fifth and sixth lines of the second spiral coil.

13. The coil component as claimed in claim 12, wherein the second line of the first spiral coil crosses the sixth line of the second spiral coil without crossing the fourth and fifth lines of the second spiral coil.

14. The coil component as claimed in claim 13, wherein the first line of the first spiral coil does not crosses the fourth, fifth and sixth lines of the second spiral coil.

15. The coil component as claimed in claim 12, wherein the first line is an innermost line among the first to third lines of the first spiral coil, wherein the third line is an outermost line among the first to third lines of the first spiral coil, wherein the fourth line is an innermost lines among the fourth to sixth lines of the second spiral coil, and wherein the sixth line is an outermost lines among the fourth to sixth lines of the second spiral coil.

16. A coil component comprising:

an insulating substrate having first and second surfaces opposite to each other;

a first spiral coil formed on the first surface of the insulating substrate, the first spiral coil having an innermost turn that is radially separated by spiral-shaped slit into at least first and second lines, the first line being positioned inner then the second line; and a second spiral coil formed on the second surface of the insulating substrate, the second spiral coil having an innermost turn that is radially separated by spiral-shaped slit into at least third and fourth lines, the third line being positioned inner then the fourth line, wherein each of the first and second coil parts has a circumferential region in which a radial position is not changed and a shift region in which the radial position is changed, wherein the first line of the first spiral coil is connected to the fourth line of the second spiral coil at the circumferential region, and wherein the second line of the first spiral coil is connected to the third line of the second spiral coil at the circumferential region.

17. The coil component as claimed in claim 16, wherein the circumferential regions of the first coil part and the circumferential regions of the second coil part coincide with each other in planar position.

18. The coil component as claimed in claim 17, wherein the insulating substrate is transparent or translucent.

* * * * *